US006134786A

United States Patent [19]

Graupner et al.

[11] Patent Number: 6,134,786

[45] Date of Patent: Oct. 24, 2000

[54] METHOD FOR IMPROVEMENT OF INVOLUTE AND LEAD ERROR IN POWDER METAL GEARS

[75] Inventors: Scott D. Graupner; John Engquist; Steven T. Haye, all of St. Charles, Ill.

[73] Assignee: Amsted Industries Incorporated, Chicago, Ill.

[21] Appl. No.: 09/240,341

[22] Filed: Jan. 29, 1999

[51] Int. Cl.[7] ..... B23P 15/14

[52] U.S. Cl. ..... 29/893.35; 409/12

[58] Field of Search ..... 29/893.35; 409/12

[56] References Cited

U.S. PATENT DOCUMENTS

| | | | |
|---|---|---|---|
| 2,839,786 | 6/1958 | Alesi | 18/16 |
| 3,786,719 | 1/1974 | Kimura et al. | 90/1.6 |
| 3,832,107 | 8/1974 | Cox et al. | 425/78 |
| 3,988,088 | 10/1976 | King et al. | 425/78 |
| 4,027,790 | 6/1977 | King | 222/285 |
| 4,327,996 | 5/1982 | Affolder | 425/78 |
| 5,154,881 | 10/1992 | Rutz et al. | 419/37 |
| 5,213,816 | 5/1993 | Smyth, Jr. et al. | 425/78 |
| 5,253,993 | 10/1993 | Birckenstock et al. | 425/78 |
| 5,256,053 | 10/1993 | Haguchi | 425/186 |
| 5,593,707 | 1/1997 | Goe et al. | 425/257 |
| 5,858,415 | 1/1999 | Bequette et al. | 425/78 |

FOREIGN PATENT DOCUMENTS 50-7084 3/1975 Japan .

OTHER PUBLICATIONS

McGraw–Hill Encyclopedia of Science and Technology—Eight Edition, vol. 7; pp. 709–719.

"Skiving of Hardened Gears", Publication from Koepfer America Limited Partnership, by Dr. Thomas Koepfer, Dennis R. Gimpert and Hans W. Porschmann from Jos. Koepfer & Sohne GmbH, Furtwangen, Germany.

"Flexible and Automatic Manufacture of Gears and Skiving of Hardened Gears", Publication from European Production Engineering, 18 (1994) 1–2, by Dr. Th. Koepfer, Dennis R. Gimpert and H. W. Porschmann, Furtwangen, Germany.

"High Speed Carbide Hobbing" by Dennis Gimpert, President, Koepfer America LLC and Cory Sanderson, Sales Engineer, Koepfer America LLC.

A Technical Paper on the Art of Gearing, Paper No. P129.27 from the American Gear Manufacturers Association, presented at the Fall Technical Meeting in New Orleans, LA, Oct. 11–13, 1982, entitled "Hard Gear Processing with Azumi Skiving Hobs" by William E. Loy, Manager, Special Products, Barber–Colman Company, Rockford, Illinois.

Tool Engineers Handbook American Society of Tooling; pp. 1073–1077; 1480–1492, and 1301; McGraw Hill Book company, 1949.

*Primary Examiner*—P. W. Echols

*Attorney, Agent, or Firm*—Edward J. Brosius; F. S. Gregorczyk; Stephen J. Manich

[57] ABSTRACT

Gears, particularly spur gears, are produced by powder metal techniques with minimal lead line error and eccentricity, which gears are preformed from powder metal, sintered, hardened and thereafter have their involute surfaces regenerated by a hard hob with a negative rake on the hob teeth to provide gears having aligned involute surfaces between adjacent gear teeth and, between each gear tooth and the gear center line.

8 Claims, 2 Drawing Sheets

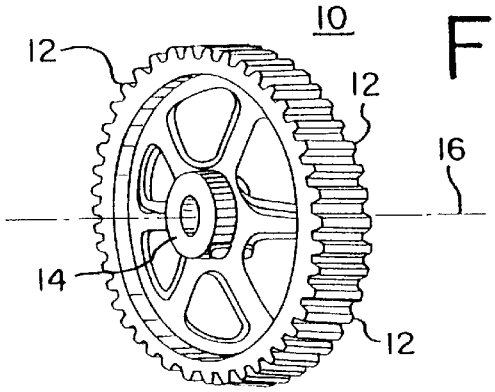
FIG. 1
FIG. 2
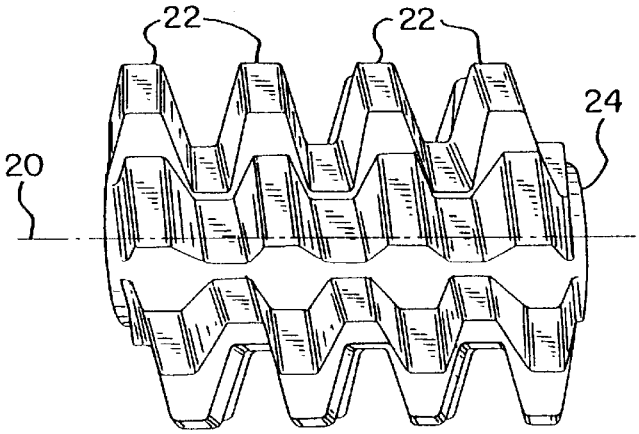
FIG. 3
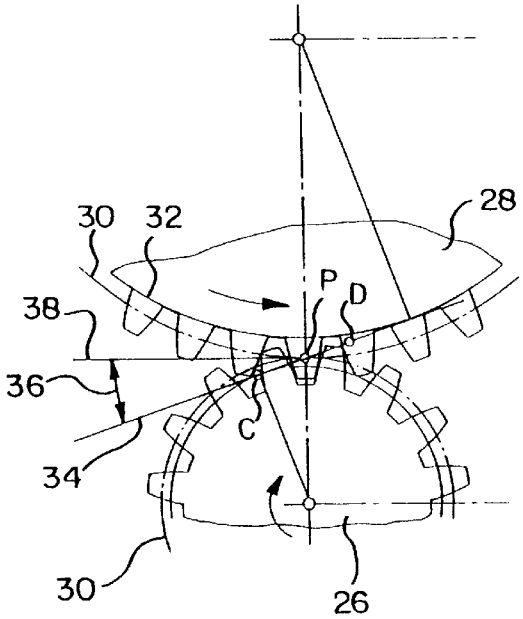
FIG. 4
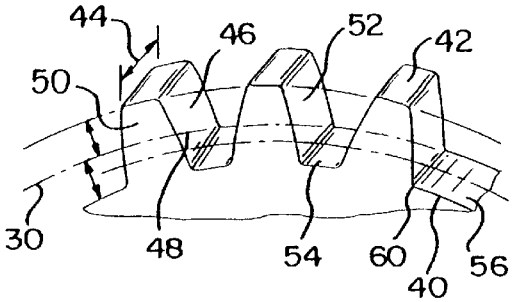

METHOD FOR IMPROVEMENT OF INVOLUTE AND LEAD ERROR IN POWDER METAL GEARS

FIELD OF THE INVENTION

The present invention relates to the manufacture of gears by a powder metal process. More specifically, the present invention provides a method and apparatus for improvement of the involute and lead error of a gear produced from powder metal, which gear has been heat treated and quenched to approximately a full-hard condition.

DESCRIPTION OF THE PRIOR ART

Gears have historically been manufactured by machining, forging and casting. During machining operations, a blank may be cut from green or soft bar stock material, and thereafter subsequent machining operations have included center boring, broaching, hobbing, shaving, heat treating to harden with post-hardening machining and grinding operations. In more recent years, gears have been manufactured by powder metal processes, particularly spur gears, which may have either straight or helical gear teeth. The powder-metal gears initially produced were generally smaller gears, but over the years the size of the powder-metal gears has increased.

Gears generally may include spur gears, bevel gears and worm gears and they may be subclassified as straight and helical spur gears; straight, spiral, zero bevel and hypoid bevel gears. This is merely a brief listing of the various terminology of the descriptive nomenclature for gears generally. Further these gears may be utilized in various arrays to provide gear trains. Spur gears are generally referred to as those gears that transmit power between parallel shafts and have straight teeth parallel to the gear axis.

At the present time, the powder metal production of gears is especially directed to spur gears. In the broadest sense, it is necessary to provide a gear that will transmit force and motion for transfer of power between parallel shafts coupled to such gearing. Satisfactory tooth-surface durability from highly loaded gears, requires that several items or physical characteristics of the gear must be properly designed and manufactured. Among the parameters that are required to be constrained to close tolerances are the following: (1) the tooth profile, which must be properly modified from a true involute to suit the operating conditions; (2) index of teeth and parallelism of teeth, which must be held within close limits; (3) gearing, which must be mounted so the teeth will not deflect out of line; and gear tooth surfaces, which must be of sufficient hardness and proper finish and which should have good lubrication, particularly on start of initial operation. Gear design and gear tooth design has been noted as a compromise between tooth strength and surface durability. Large teeth provide greater strength but less surface durability than smaller teeth, and vice versa.

A highly loaded gear tooth of adequate rigidity deflects about a point in the middle of the rim, bending as a rigid body under load rather than as a nonuniform beam only. Relief or other modification of tooth profile provides clearance to avoid excessive loading at tooth tips due to deflection of the preceding mesh, and ramps at the tooth tips assure that first contact does not extend to the tips. It is this design refinement which necessitates caution in gear production to avoid distortion during carburizing or heat treating. Teeth can be held parallel within 0.0003 inch in the width of the tooth and the index may be maintained within 0.0002 inch between adjacent teeth of a gear.

The reference to involute of a gear tooth has been roughly defined as being laid out along an involute, which is the curve generated by a point on a taut wire as it unwinds from a cylinder. The generating circle is called the base circle of the involute. The involute curve establishes the tooth profile outward from the base circle. From the base circle inward, the tooth flank ordinarily follows a radial line and is faired into the bottom land with a fillet. The basic rack form of the involute tooth has straight sides.

As noted above, the earlier methods were noted, and of these methods the primary technique for the production of gears, such as for the automotive industry, was machining of steel bar stock to produce a finished gear. Lighter load bearing gears, such as for watches and sewing machines, were occasionally produced by stamping sheet metal, but broadly speaking, gears for load transfer were produced by machining and forming steel bar stock. However, all gears suffer from the requisite for alignment of the gear teeth between each other and with the gear center line. Further, maintaining proper contact between meshing gear teeth flanks on the bearing point, which is about halfway from the root to the crown of each tooth is an important consideration for proper wear, strength and low noise. Attainment of the proper finished gear surfaces generally includes finishing the gear surfaces by grinding the bearing surfaces, lapping and matching the gear teeth or by grinding the internal bore. Further, gears may be mounted on fixtures prior to heat treating to minimize distortion during heat treatment. All of these operations are added expenses and require both capital equipment and skilled labor to produce a finished and acceptable gear.

Production of gears by the powder metal process provides for lower cost parts with generally equivalent mechanical properties for an application. That is, powder metal is formed into a preform in a die on a powder metal press at a rate that is several times faster than any one single machining operation. These preform or green gears are formed with gear teeth and bores at predetermined dimensions and in alignment. Further, these parts avoid scrap losses, avoid a plurality of tool and machine requirements and generally minimize the requirements of a plurality of skilled machininsts. These preforms are in condition for sintering, which is generally performed on a continuous belt in a muffle furnace. The sintering and heat treating operations in some cases may be performed in different zones of the same furnace. However, if desired intermediate operations, such as coining after sintering may be performed prior to heat treating and hardening. The specific sequence of operations may be determined by the requirements of the particular part, its size, and the available production equipment. However, subsequent skiving operations after hardening regenerated the relations between gear teeth and the centerline at least as well as hard grinding with a threaded wheel grinder. It should be noted that honing of a gear is not intended to regenerate gear geometry or to correct significant generating errors. More specifically, honing will lightly affect the surface quality of individual gear teeth but has little to no impact on gear geometry. It has been found that the dominant variants of gears produced by powder metal techniques are axial misalignment of the tooth flanks relative to the gear bore or gear longitudinal center line, and the taper or misalignment of the tooth flanks relative to each other and the gear bore. These geometry variants are generated by any of the following operations either individually or in combination: pressing, sintering, coining, heat-treating or, bore and face grinding. These gear geometry variants are accommodated by post-heat treatment hard hobbing.

SUMMARY OF THE INVENTION

The present invention provides the manufacture and production of gears, particularly spur gears, by powder metal techniques. The presently as-produced powder-metal gears would suffer the same constraints or flaws as machined gears. Consequently, a new technique has been developed to provide gears which overcomes the limitations of misalignment between gear teeth and, misalignment between gear teeth and the gear center line, or lead line error. In addition, the present invention regenerates the as-formed relationship between the gear teeth and the centerline, it provides a surface finish on the gear teeth that avoids the requirement for honing and it avoids undercutting the root area between adjacent gear teeth thus enhancing the strength and durability of the gear. The gears are regenerated by skiving the gear after heat treatment to realign the gear teeth with each other and the gear center line, to overcome misalignment and lead line error. In addition, this operation is performed with hard hob tooling, which is significantly faster than grinding or rehoning. The hard hob has a negative rake hob on a hobbing machine that is stable and avoids large machine generated backlash to remove any necessity for hard grinding of the gear teeth, the central bore or the end-bearing surfaces.

BRIEF DESCRIPTION OF THE DRAWING

In the several figures of the Drawing, like reference numerals identify like components, and in those drawings:

FIG. 1 is an oblique view of an exemplary spur gear;

FIG. 2 is a plan view of an illustrative hob for cutting gear teeth;

FIG. 3 is a partial elevational view of intersecting gears;

FIG. 4 is an enlarged segment of gear teeth;

DETAILED DESCRIPTION OF THE PREFERRED EMBODIMENT

The present invention provides a method for the production and regeneration of gears, especially spur gears, which gears are manufactured from powder metal. FIG. 1 illustrates an exemplary spur gear 10 with a plurality of gear teeth 12 and a central bore 14, which bore 14 has central longitudinal axis 16. Gears generally have been produced by various production methods including machining, casting, forging and stamping. However, the primary manufacturing technique for gears for power transfer has been by machining practices, such as turning, drilling, boring, milling, planing, shaping, slotting, sawing, broaching, filing and generating, and usually multiple combinations of these processes.

Figure 7:
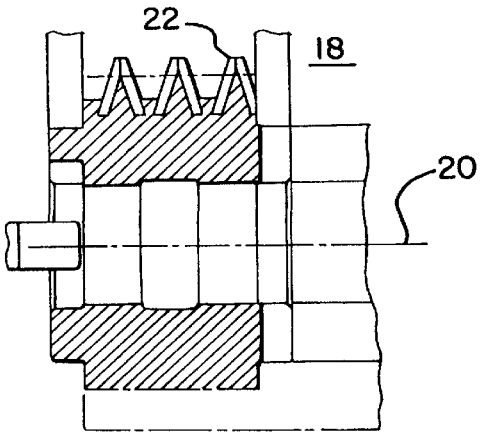
FIG. 7 is a cross-sectional view of a hob for hard hobbing, which hob has negative rake cutting teeth; and, FIG. 8 is an end-view of the hob in FIG. 7 noting the negative rake of the cutting teeth.
Figure 8:
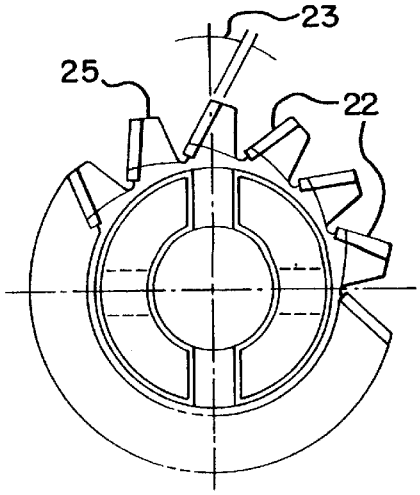

In the case of generating, this term is frequently utilized with reference to hobbing machines or gear generators. Hobs or hob cutters are the tools that cut gear teeth, not only on spur gears but on eight gears, which is a splined shaft with four gears cut therein, splined shafts, helical gears and other types of gears. Hob cutters 18 in FIGS. 2, 7 and 8 are defined as formed milling cutters, the teeth 22 of which lie in a helical path about the circumferential surface of the cutter. Hob cutters 18 are generally used for cutting spur and spiral gears, worm wheels, sprocket teeth, ratchets, spline shafts, square drive shafts and other gears. Hob cutter 18 with longitudinal axis 20 is noted in FIG. 2 with a plurality of cutting teeth 22. Hobbing by definition is a continuous milling operation in which the hob and the blank or green raw material rotate in timed relation to each other. In addition to the rotary motion the hob and the gear blank are fed relatively to each other to produce the spur, helical, or worm gear. Hobbing of a gear provides a rolling action in relation to the hob. This rotation produces the involute contour of the gear tooth. The reference to generating a gear, and the involute contour, by hobbing is performed by the relative rotary motion of a gear blank (not shown) and hob cutter 18. A hob cutter or hob 18 has been described as a series of rack teeth 22 arranged in a spiral around the periphery of a hub 24. As hob cutter 18 rotates in unison with the gear blank it provides the generating action, and as hob cutter 18 is fed across the face of the gear blank it cuts gear teeth 12. In FIG. 2, hob 18 rotates around axis 20 with the spiral configuration noted on hob 18.

Gears, particularly spur gears 10, as illustrated in FIG. 1, include a plurality of parameters or characteristics which are used to describe the gear. FIG. 3 illustrates the interaction of a meshed pinion or driver gear 26 with a larger diameter or driven gear 28. This illustration is merely exemplary and not a limitation. The pitch circle 30 of gears 26 and 28 are noted in this figure as well as the base circle 32, pressure line 34 between contacting gear teeth 12, and pressure angle 36 between common tangent 38 and pressure line 34. More specifically, FIG. 4 is an enlarged view of a segment of gear teeth 12 noting pitch circle 30 about at the midpoint between root or root circle 40 and top land 42 of each tooth 12. Each of gear teeth 12 has face width 44, face 46, flank 48 and tooth thickness 50 along pitch circle 30. Bottom land 54 between adjacent teeth 12 is noted along base circle 56 while the tooth space 52 is provided between teeth 12 along pitch circle 30. Root fillet 60 is shown at the intersection of bottom land 54 and flank 48. Face 46 is the tooth surface radially outward from pitch circle 30.

Figure 5:
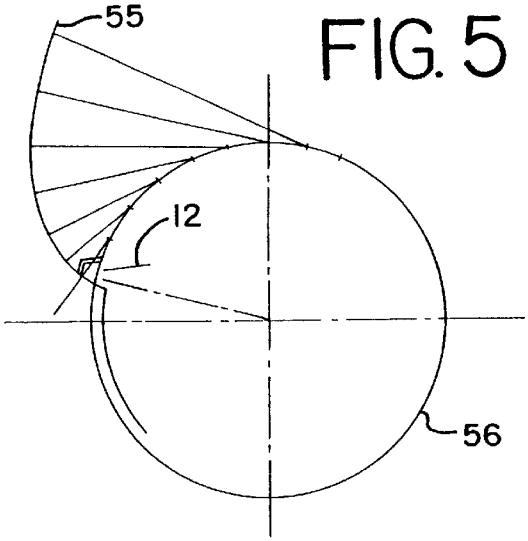
FIG. 5 is an illustrative geometric method of generation for the face of an involute gear tooth.

The above-noted involute is generated on tooth face 46 and flank 48 by the interaction of the rotation of hob cutter 18 and a work piece (not shown) during the traditional hobbing process. This involute tooth 12 is laid out along an involute, as noted in FIG. 5, which is the curve 55 generated by a point on a taut wire as it unwinds from a cylinder. The generating circle is called the base circle of the involute. This involute establishes the tooth profile outward from base circle 56.

Gear teeth 12 may interfere with one another when they mesh as in FIG. 3. Point C in FIG. 3 is the point of initial contact between gear teeth, which is after the point of tangency between pressure line 34 and base circle 32. If contact C preceded the point of tangency P this would be indicative of premature contact on the noninvolute surfaces of the teeth, that is a contact occurring on the noninvolute portion of tooth flank 48 below base circle 32. The tip of tooth 12 thus digs into flank 48 of pinion gear 26. This latter condition is undesirable, as it is the intention of the manufacturer to provide gears that run on the involute surface about at pitch circle 30 of each gear tooth 12.

Gears and gear teeth 12 are evaluated or inspected for factors or characteristics such as runout, tooth spacing, eccentricity, tooth form, pressure angle and tooth alignment. These are some examples of the physical characteristics of gears, that must be analyzed for conformation of the quality of an acceptable gear. A consequence of a poor or low-quality gear for example is the noise it will generate when operating. During the manufacture of gears 10, it is known that gear teeth 12 can become misaligned relative to each other and to center line 16 of gear 10. Therefore, gears 10 are frequently regenerated on grinding machines after heat treating to regenerate gear teeth relationships.

Figure 6:
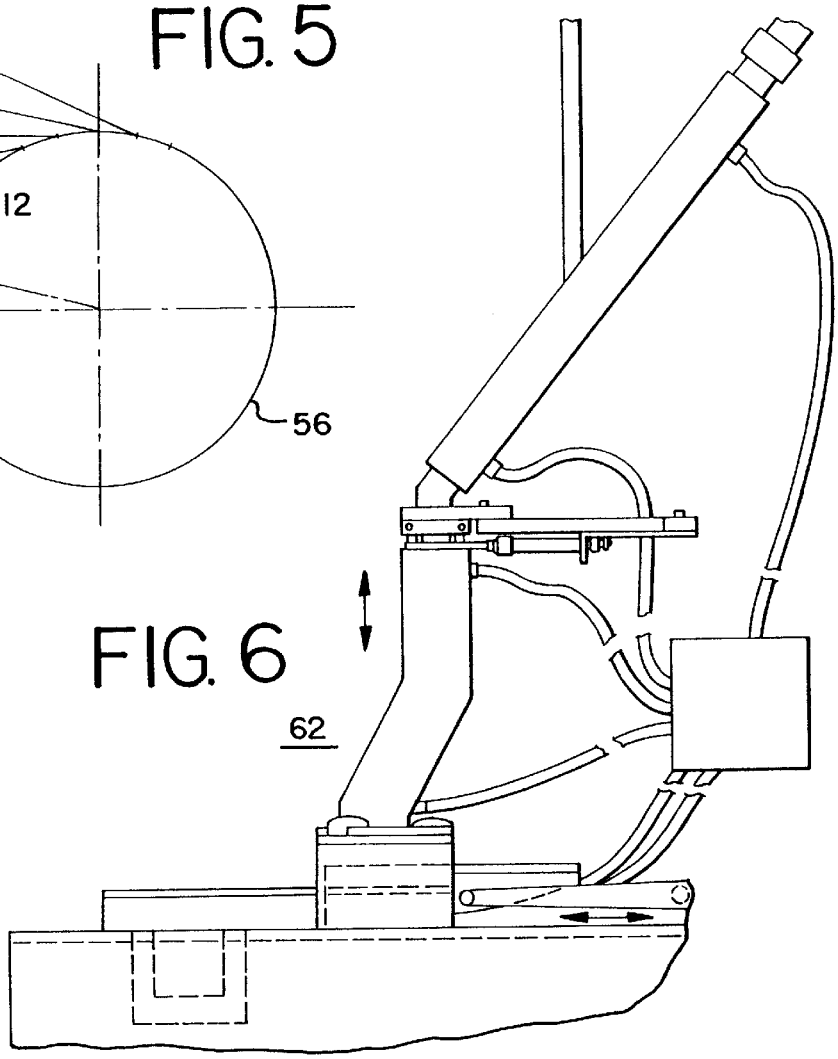
FIG. 6 is a partial side elevational view of a powder press for preforming powder metal parts.

The present invention provides gears 10 produced by a powder metal technique. More specifically, gears 10 are pressed into a preform on a powder metal press 62 such as the press illustrated in U.S. Pat. No. 5,858,415 to Bequette et al. and in FIG. 6. The preform, which has the desired gear shape but is not at finished dimensions, is broadly comprised of a predetermined mass or volume of a particular metal powder, which is generally an alloy composition such as A-5, A-9, QMP-4600 or Hoeganaes HP-85 for example. The powder mass is compressed to a preform of a predetermined shape and green density. The preform is thereafter transferred to a sintering furnace for fusing of the discrete particulates. This preform is a relatively loose agglomeration of discrete powder particles, which preform has only nominal strength and hardness, although the individual metal particles will have their own characteristic metal strength. During sintering, the preform may further compress and the apparent density of the preform will increase. Subsequent operations may include coining of the sintered preform to further increase the density and to conform the shape to a finished dimension. In the case of spur gear 10, the density of the preform after coining may be adequate, but a subsequent hardening heat-treatment may be performed to elevate at least the gear surface to a requisite hardness value.

As an example, the density of iron at 20° C. is 7.874 g./cc. The present invention provides a powder metal gear with a finished density of about 7.3 g./cc., which is about 88% of the theoretical density of the metal material. However, as in most heat treating operations gears 10 are susceptible to distortions from either the sintering or hardening operations. The distortion of the preform from its as-formed state can result in misalignment between adjacent gear teeth 12 or between gear teeth 12 and center line 16. In extreme cases of distortion, the bearing surfaces at the ends of the gear or gear bore 14 can become misaligned relative to gear teeth 12 or center line 16.

Previous gear technology has required that gear 10 and thus gear teeth 12 be regenerated to realign teeth 12 with each other or center line 16 to provide gear 10 as an adequate power transfer device with minimal noise. However, until relatively recent years the methods known to produce an acceptable gear 10 were limited to grinding finished and hardened gear 10 for regeneration of gear teeth 12. In 1974, U.S. Pat. No. 3,786,719 to Kimura et al. taught a method of hobbing hardened gear 10 to regenerate the gear parameters. More particularly, the specific hobbing cutter was provided with cutting teeth 22 having a negative or backward angle 23 relative to the direction of cutter 18 as shown in FIG. 8. These hard hobbing cutters 18 have the top fillets 25 removed as there is no cutting in the root region 60 of gear teeth 12. Deletion of this top cutting surface results in a concave shape in root 60 without an undercut.

The present invention utilizes hardened hob cutter 18 in cooperation with a stable hob cutting apparatus and hardened arbors (not shown) with accurate centers will regenerate gear 10, and particularly a spur gear, with aligned gear teeth 12, which teeth 12 are also aligned with gear center line 16. Gear teeth 12 have a smooth transition at roots 60 without the undercut, as this process serves to skive or remove extremely thin layers of material on the involute surface 46,48 of gear teeth 12 to thereby regenerate tooth surface 46, 48. It has been found that gears 10 are of a quality, that is as good or as acceptable as gears 10 ground to regenerate surface 46,48. Further, hard hobbing is operable at a rate that is orders of magnitude faster than prior grinding operations. Gross errors in gear tooth patterns and profiles have historically been corrected during the cutting operations. Alternatively, gear errors are sometimes lapped to correct a reasonable amount of errors, but attempting to correct excessive errors by lapping through long cycles is not desirable.

The present invention provides for skiving small amounts of material from the gear teeth, that is on the order of 0.005 to 0.007 inch of material, to regenerate alignment of gear teeth 12 without contacting root 60 or undercutting root 60, while maintaining involute surface 46,48 of each gear tooth face 46 and flank 48.

While only a specific embodiment of the invention has been described and shown, it can be appreciated that various alternatives and modifications can be made thereto. Those skilled in the art will recognize that certain modifications can be made in these illustrative embodiments. It is, therefore, the intention in the appended claims to cover all such modifications and alternatives as may fall within the true scope of the invention.

We claim:

1. A method of manufacturing a spur gear produced from a powder metal, said spur gear having a plurality of gear teeth, each said tooth having gear-tooth flanks, said gear having a longitudinal center line, said method operable to regenerate gear alignment to reduce misalignment between adjacent gear teeth flanks, to reduce misalignment between said gear teeth and to reduce lead line error of each said gear, said manufacturing method comprising:

(a) pressing a powder metal preform of said spur gear, each said gear having a longitudinal center line and a plurality of gear teeth, each said gear tooth having a gear-tooth flank;

(b) sintering said spur gear preform to generally solidify said powder metal preform;

(c) heat treating said sintered preform to a predetermined minimum hardness;

(d) providing a hardened hob and a stable hard-hobbing apparatus;

(e) skiving said sintered and heat treated gear with said hardened hob on said hard-hobbing apparatus to remove between about 0.005 and 0.007 inch of material on each gear tooth flank, said skiving acting to regenerate the as-formed relationship among said gear teeth and between said gear teeth and said longitudinal center line of each said gear.

2. A method of manufacturing a spur gear of powder metal as claimed in claim 1 wherein said heat treating of said pressed and sintered preform produces a gear having a minimum hardness of Rockwell-C 52.

3. A method of manufacturing a spur gear of powder metal as claimed in claim 1 wherein said heat treating of said pressed and sintered preform produces a gear having a hardness between Rockwell-C 52 and Rockwell-C 60.

4. A method of manufacturing a spur gear of powder metal as claimed in claim 1 wherein said adjacent gear teeth have a root between said adjacent teeth, said skiving of said gear teeth is provided while maintaining said root untouched and avoiding undercutting said root.

5. A method of manufacturing a spur gear of powder metal as claimed in claim 1 wherein said powder metal is any of A-5 prealloyed powder, A-9 prealloyed powder, 4600 grade powder, QMP-4600 grade powder and HP-85 powder.

6. A method of manufacturing a spur gear of powder metal as claimed in claim 1 wherein said heat treating is provided by a neutral hardening process with a cold oil quench at less than 150° F.

7. A method of manufacturing a spur gear of powder metal as claimed in claim 1 wherein said hardened hob has a plurality of cutting elements, said cutting elements having one of a zero rake and a negative rake.

8. A method of manufacturing a spur gear of powder metal as claimed in claim 7 wherein said hob has a center line, said negative rake of said cutting elements being about a negative five degrees from said center line.

* * * * *